US009984547B2

(12) United States Patent
Zhang

(10) Patent No.: US 9,984,547 B2
(45) Date of Patent: May 29, 2018

(54) SERVER AND METHOD FOR MANAGING OBJECTS

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Xue-Qin Zhang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days. days.

(21) Appl. No.: 15/468,125

(22) Filed: Mar. 24, 2017

(65) Prior Publication Data

US 2017/0287294 A1 Oct. 5, 2017

(30) Foreign Application Priority Data

Mar. 31, 2016 (CN) ..... 2016 1 0196438

(51) Int. Cl.
*G08B 13/24* (2006.01)

(52) U.S. Cl.
CPC ..... *G08B 13/248* (2013.01); *G08B 13/2462* (2013.01)

(58) Field of Classification Search
CPC ..... G08B 7/06; G08B 13/2462; G08B 13/248
See application file for complete search history.

(56) References Cited

U.S. PATENT DOCUMENTS 9,740,895 B1 * 8/2017 Liu ..... G06K 7/10366
2007/0136152 A1 * 6/2007 Dunsker ..... G06Q 10/08 705/28
2009/0327102 A1 12/2009 Maniar et al.
2013/0107042 A1 5/2013 Forster

FOREIGN PATENT DOCUMENTS

CN 103455899 A 12/2013

* cited by examiner

*Primary Examiner* — Leon Flores
(74) *Attorney, Agent, or Firm* — ScienBiziP, P.C.

(57) ABSTRACT

A managing method includes establishing a relationship between basic information of each object of a plurality of objects and each positioning tag of a plurality of positioning tags, wherein the basic information of each object comprising status information of the each object. Position information is obtained from each positioning tag and the status information of each object is obtained at every predetermined time. Once at least one object of the plurality of objects is determined not located in a predetermined area and the at least one object is in an approved state, the positioning tag corresponding to the at least one object is controlled to transmit an alarm.

15 Claims, 5 Drawing Sheets

SERVER AND METHOD FOR MANAGING OBJECTS

CROSS-REFERENCE TO RELATED APPLICATIONS

This application claims priority to Chinese Patent Application No. 20161196438.0 filed on Mar. 31, 2016, the contents of which are incorporated by reference herein.

FIELD

The subject matter herein generally relates to managing technology, and particularly to a server and a method for managing objects.

BACKGROUND

Generally, a warehouse can be used to store various kinds of materials. However, it is hard for a manager of the warehouse to manage the various kinds of materials stored in the warehouse. For example the manager may need to manually check whether one of the various kinds of materials is approved for removal from the warehouse.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
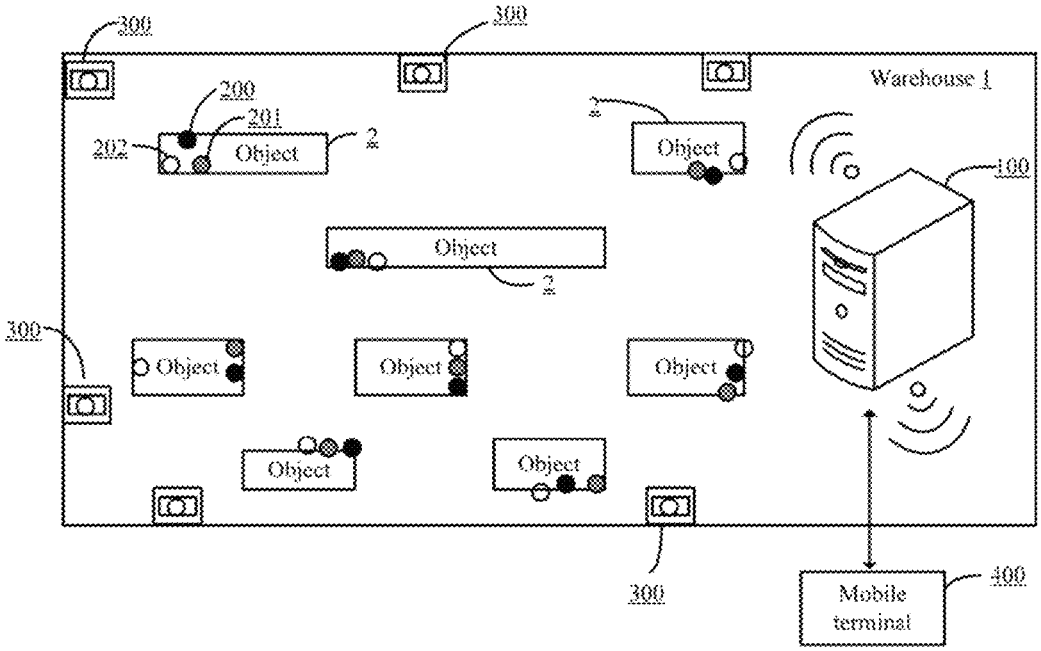
FIG. 1 illustrates an example mapping of objects in a warehouse.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. It should be noted that references to "an" or "one" exemplary embodiment in this disclosure are not necessarily to the same exemplary embodiment, and such references mean "at least one."

Furthermore, the term "module", as used herein, refers to logic embodied in hardware or firmware, or to a collection of software instructions, written in a programming language, such as, JAVA, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY, flash memory, and hard disk drives.

Figure 2:
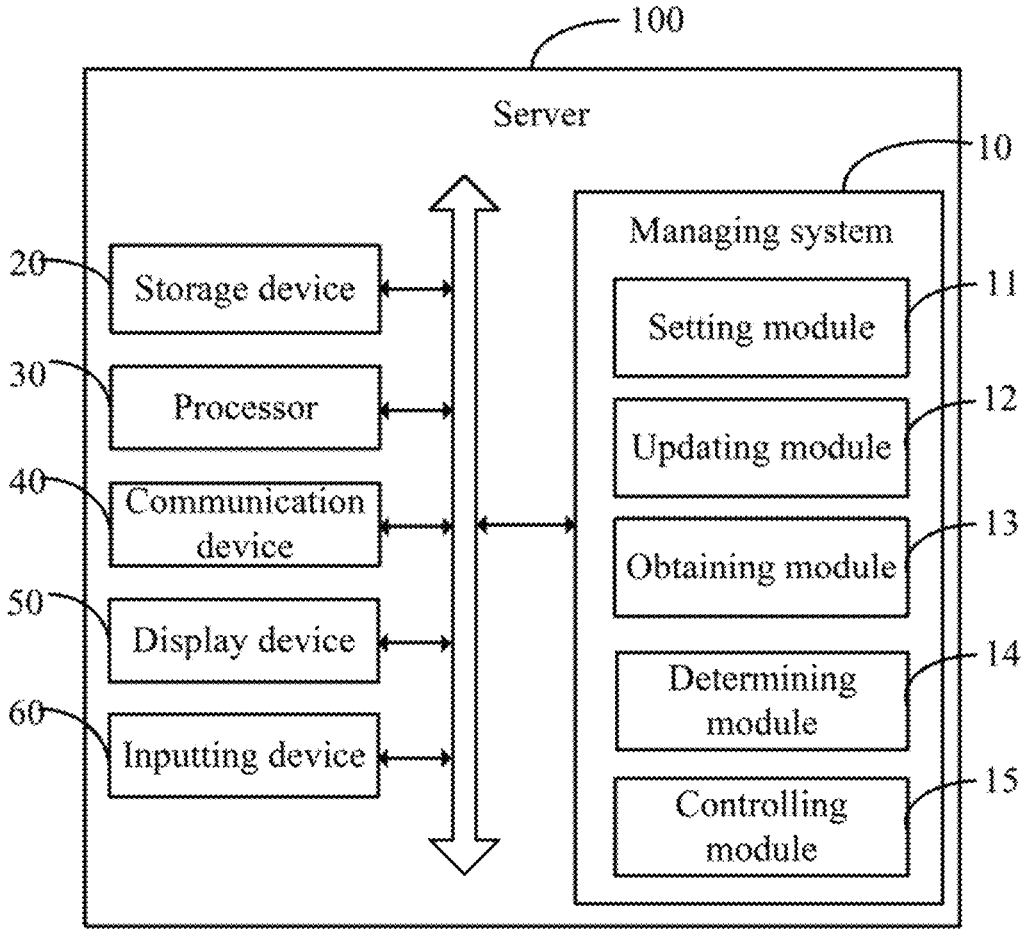
FIG. 2 illustrates a block diagram of an exemplary embodiment of a server including a managing system.

FIG. 1 illustrates an example of a warehouse 1. FIG. 2 illustrates a block diagram of an exemplary embodiment of a server 100 including a managing system 10. The managing system 10 can be used to manage a number of objects 2 stored in the warehouse 1.

In at least one exemplary embodiment, each object 2 can be a box of material, a bag of rice, a dozen boxes, a computer case, a box of wheel gears, a motor, etc. In at least one exemplary embodiment, each object 2 corresponds to a positioning tag 200. For example, each object 2 may be tagged with a positioning tag 200. A number of camera devices 300 are configured in different positions of the warehouse 1. In at least one exemplary embodiment, each of the number of camera devices 300 has a predetermined position. The predetermined position can be indicated using a longitude and a latitude. The plurality of camera devices 300 can be used to capture images from the different positions. In at least one exemplary embodiment, the positioning tag 200 can be an electronic tag that is configured with indoor accurate positioning functions. In other words, each positioning tag 200 can provide current position information of the corresponding object 2 to another device (e.g., the server 100) when such device is in communication with the positioning tag 200. In at least one exemplary embodiment, the positioning tag 200 is configured with an audio device 201 and a lighting device 202. The audio device 201 may be a speaker that can be used to play a warning audio signal. The lighting device 202 may be a light emitting diode flash light that can be used to emit light to facilitate searching by a manager of the warehouse 1 for the object 2. In at least one exemplary embodiment, the audio device 201 and the lighting device 202 can be integrated in the positioning tag 200. In other exemplary embodiment, the audio device 201 and the lighting device 202 can be externally connected to the positioning tag 200.

In at least one exemplary embodiment, the server 100 can communicate with the number of positioning tags 200, the number of camera devices 300, and a mobile terminal 400 through a wired or wireless communication method. The mobile terminal 400 can be a handheld electronic device of the manager, such as the mobile terminal 400, which can be a tablet computer, or a mobile phone. In at least one exemplary embodiment, the wireless communication method can be realized through WIFI, BLUETOOTH, ZIGBEE, or the like.

In at least one exemplary embodiment, as illustrated in FIG. 2, the server 100 can further include a storage device 20, at least one processor 30, a communication device 40, a display device 50, and an inputting device 60. The storage device 20 can be used to store all kinds of data such as codes of program instructions of the managing system 10. In at least one exemplary embodiment, the storage device 20 can be an internal storage device such as a memory of the server 100. In other exemplary embodiments, the storage device 20 can be external storage device of the server 100. For example, the storage device 20 can be a secure digital card, a smart media card, or a flash card. The at least one processor 30 is in communication with the storage device 20, the communication device 40, the display device 50, and the inputting device 60. The at least one processor 30 can execute program codes and all kinds of data stored in the storage device 20 to provide corresponding functions of the server 100. In at least one exemplary embodiment, the at least one processor 30 can be internally configured in the server 100, or can be externally connected with the server 100. In at least one exemplary embodiment, the communication device 40 can be used to transmit data between the server 100 and the number of positioning tags 200, the number of camera devices 300, and the mobile terminal 400. In at least one exemplary embodiment, the communication device 40 can be a BLUETOOTH device, a WIFI device, or a ZIGBEE device. In at least one exemplary embodiment, the display device 50 can be a touch device such as a liquid crystal display touch screen or an organic light emitting diode touch screen. The display device 50 can be used to display a user interface of the managing system 10. The inputting device 60 can be used to receive data input by a user. In at least one exemplary embodiment, the inputting device 60 can be a keyboard, a mouse, and/or a touch screen. In at least one exemplary embodiment, the display device 50 and the inputting device 60 can be combined as a touch screen.

In at least one exemplary embodiment, the managing system 10 can include a setting module 11, an updating module 12, an obtaining module 13, a determining module 14, and a controlling module 15. The modules 11-15 include computer instructions or codes in form of one or more programs that may be stored in the storage device 20, and are executed by the at least one processor 30.

The setting module 11 can provide a first user interface for setting basic information of each object 2 in response to user input. The setting module 11 can further establish a relationship between the basic information of each object 2 and the corresponding positioning tag 200.

In at least one exemplary embodiment, when the object 2 is ready to be stored in the warehouse 1, the manager can install a positioning tag 200 on the object 2. In at least one exemplary embodiment, the positioning tag 200 is initialized before the installation on the object 2. In at least one exemplary embodiment, when the manager presses or clicks a predetermined button that is provided by the setting module 11, the setting module 11 can provide the first user interface. The manager can set the basic information of the object 2 and the corresponding positioning tag 200 on the first user interface, and the setting module 11 can establish the relationship between the corresponding positioning tag 200 and the basic information of the object 2. In at least one exemplary embodiment, the setting module 11 can generate a number for the corresponding positioning tag 200 according to a preset rule, and can further store the number into the corresponding positioning tag 200, for example, the setting module 11 can store the number into a storage device of the corresponding positioning tag 200. In at least one exemplary embodiment, the preset rule can be defined as sequentially numbering positioning tags 200 using Arabic numerals. For example, the setting module 11 can generate an Arabic numeral "1" for a first positioning tag 200, and can generate an Arabic numeral "2" for a second positioning tag 200, and so on. In at least one exemplary embodiment, the basic information of the object 2 can include, but is not limited to, a name, a model, a specification, a size, a weight, a use purpose, date of entering the warehouse 1, supplier information, and status information of the object 2. In at least one exemplary embodiment, the status information of the object 2 can be defined as removal permission applied to the object 2. For example, when the object 2 is allowed to be taken out from the warehouse 1, the object 2 is in an approved state. When the object 2 is not allowed to be taken out from the warehouse 1, the object 2 is in a non-approved state.

In at least one exemplary embodiment, the setting module 11 can establish the relationship by storing the basic information of the object 2 into the corresponding positioning tag 200. In other exemplary embodiments, the setting module 11 can establish the relationship according to the following steps: the setting module 11 obtains the basic information of the object 2 and generates the number for the corresponding positioning tag 200; then the setting module 11 establishes the relationship using the number of the corresponding positioning tag 200 and the basic information of the object 2; and then the setting module 11 stores the basic information of the object 2 and the relationship into the storage device 20.

In at least one exemplary embodiment, the basic information of the object 2 can further include an application form that is used for applying to take out the object 2 from the warehouse 1. When a user such as the manager needs to take out an object 2 from the warehouse 1, the setting module 11 can provide a second user interface for filling out the application form in response to user input. In at least one embodiment, information of the application form can include, but is not limited to, the number of the positioning tag 200 that is corresponding to the one object 2. In at least one exemplary embodiment, the setting module 11 can set an approval process for the application form. In at least one exemplary embodiment, the approval process can be defined as a process of transmitting the application form to one or more predetermined members for approval. When each of the one or more predetermined members has approved the removal of the one object 2, the approval process is completed.

The updating module 12 can further add the application form to the basic information of the object 2. In at least one exemplary embodiment, the updating module 12 can further update the status information of the object 2 according to the approval process. In at least one exemplary embodiment, when the application form is currently approved by the one or more predetermined members, the updating module 12 can update the status information of the object 2 to indicate the approved state.

Figure 3:
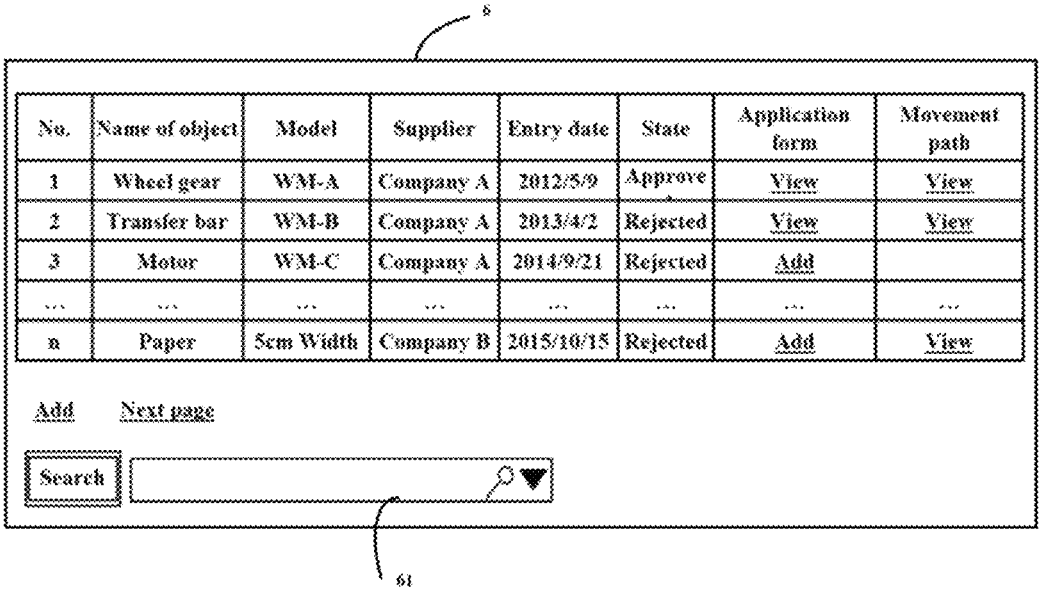
FIG. 3 illustrates an exemplary embodiment of a user interface of the managing system.

In at least one exemplary embodiment, the determining module 14 can obtain the basic information of each object 2, and can determine whether the basic information of each object 2 contains the application form. When the basic information of one object 2 contains the application form, the determining module 14 can further determine whether the application form has been approved by the one or more predetermined members. When the application form has been approved, the updating module 12 can update the status information of the one object 2 into the approved state. In at least one exemplary embodiment, as illustrated in FIG. 3, the controlling module 15 can control the display device 50 to display the number of each of the plurality of positioning tags 200 and the basic information of the object 2 that corresponds to the each of the plurality of positioning tags 200.

The obtaining module 13 can obtain position information from each positioning tag 200 at every predetermined time (e.g., at every 5 minutes) and can obtain the status information of the object 2 that corresponds to the each positioning tag 200 at the every predetermined time. In at least one exemplary embodiment, the position information can be presented using a longitude and a latitude coordinate.

In at least one exemplary embodiment, when the basic information of each object 2 is stored in the corresponding positioning tag 200, the obtaining module 13 can obtain the status information of the object 2 by obtaining the basic information of the object 2 from the corresponding positioning tag 200, and then obtaining the status information of the object 2 from the obtained basic information. In other exemplary embodiments, when the basic information of each object 2, and the relationship between the basic information of each object 2 and the corresponding positioning tag 200 are stored in the storage device 20, the obtaining module 13 can obtain the number of the corresponding positioning tag 200 and then obtain the basic information of the object 2 from the storage device 20 according to the obtained number and the relationship.

In at least one exemplary embodiment, the determining module 14 can determine whether the object 2 is not located in an area of the warehouse 1 according to the obtained position information. In at least one exemplary embodiment, the area of the warehouse 1 is predetermined. For example, the area of the warehouse 1 can be predetermined using longitudes and latitudes. When the object 2 is not located in the area of the warehouse 1, the determining module 14 can further determine whether the object 2 is in the approved state according to the status information of the object 2. When the object 2 is not located in the area of the warehouse 1 and the object 2 is not in the approved state, the controlling module 15 can control the corresponding positioning tag 200 to transmit an alarm. In at least one exemplary embodiment, the controlling module 15 can send a first controlling signal to the corresponding positioning tag 200, the corresponding positioning tag 200 can transmit the alarm by controlling the audio device 201 to transmit a predetermined warning audio signal in response to the first controlling signal. In other exemplary embodiments, the controlling module 15 can further send a second controlling signal together with the first controlling signal to the corresponding positioning tag 200, the corresponding positioning tag 200 can transmit the alarm by further controlling the lighting device 202 to flash in response to the second controlling signal.

Figure 4:
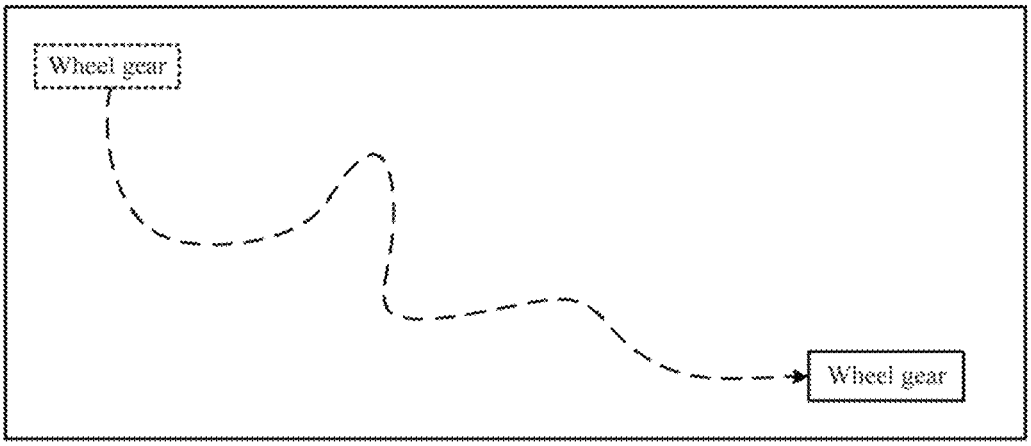
FIG. 4 illustrates an exemplary embodiment of a movement path of an object of the warehouse of FIG. 1.

In at least one exemplary embodiment, the obtaining module 13 can further display, in response to user input, a movement path of each object 2. As illustrated in FIG. 3, the obtaining module 13 can display the movement path of the object 2 when a "view" button corresponding to a column of the movement path illustrated in FIG. 3 is pressed. In at least one exemplary embodiment, the obtaining module 13 can generate the movement path of each object 2 according to the obtained positioning information at the every predetermined time, the controlling module 15 can control the display device 50 to display the movement path. For example, when the manager clicks the "view" button corresponding to the column of "movement path" and the object "wheel gear", the controlling module 15 can control the display device 50 to display the movement path of the wheel gear as illustrated in FIG. 4.

In at least one exemplary embodiment, the obtaining module 13 can receive key information from an input box 61 of a user interface 6, as illustrated in FIG. 3. The controlling module 15 can determine one or more positioning tags 200 by searching the storage device 20 according to the key information. In at least one exemplary embodiment, the key information can be the name of the object 2, the number of the corresponding positioning tag 200, the size of the object 2, or the like. The controlling module 15 can further control the determined one or more positioning tags 200 to turn on the lighting device 202, thus the manager can easily find the objects 2 corresponding to the determined one or more positioning tags 200.

In other exemplary embodiments, the obtaining module 13 can further obtain the position information of the determined one or more positioning tags 200. The obtaining module 13 can determine one or more of the plurality of camera devices 300 corresponding to the determined one or more positioning tags 200 according to the obtained position information and the predetermined position of each of the number of camera devices 300. The controlling module 15 can control the determined camera devices 300 to capture images and can control the determined camera device 300 to send the captured images to the mobile terminal 400 through the communication device 40, thus the manager can use the mobile terminal 400 to view the objects 2 stored in the warehouse 1. In at least one embodiment, the obtaining module 13 can determine one of the number of camera devices 300 that is located closest to a specific positioning tag 200 and corresponds to that specific positioning tag 200.

Figure 5:
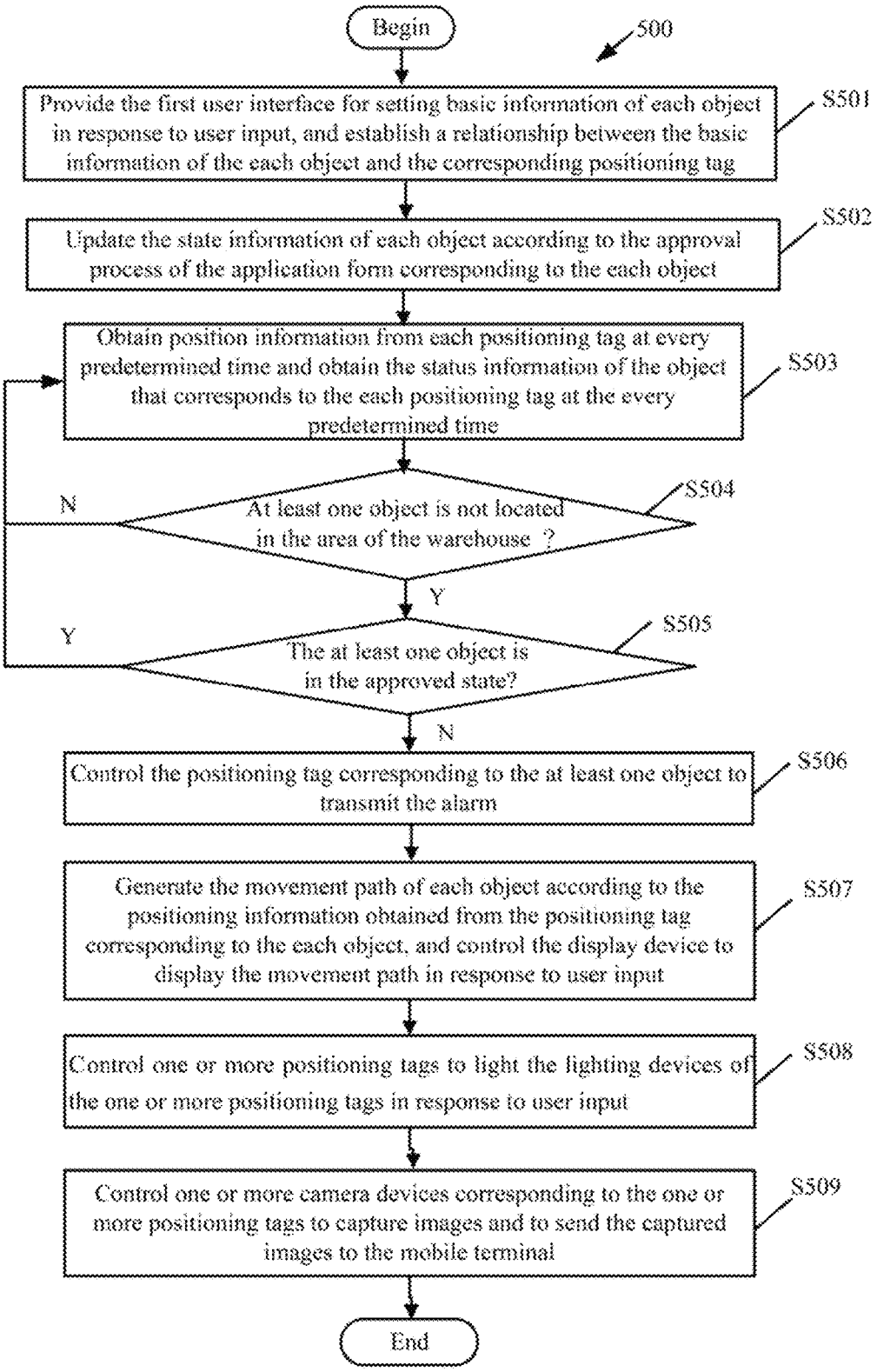
FIG. 5 is a flowchart of an exemplary embodiment of a method of managing objects in the warehouse of FIG. 1.

FIG. 5 illustrates an exemplary embodiment of a flowchart of a method. The example method 500 is provided by way of example, as there are a variety of ways to carry out the method. The method 500 described below can be carried out using the configurations illustrated in FIG. 1, for example, and various elements of these figures are referenced in explaining example method 500. Each block shown in FIG. 5 represents one or more processes, methods, or subroutines, carried out in the example method 500. Additionally, the illustrated order of blocks is by example only and the order of the blocks can be changed according to the present disclosure. The example method 500 can begin at block S501. Depending on the exemplary embodiment, additional steps can be added, others removed, and the ordering of the steps can be changed.

At block S501, the setting module 11 can provide the first user interface for setting basic information of each object 2 in response to user input. The setting module 11 can further establish a relationship between the basic information of each object 2 and the corresponding positioning tag 200.

At block S502, the updating module 12 can update the status information of each object 2 according to the approval process of the application form corresponding to each object 2.

In at least one exemplary embodiment, the determining module 14 can obtain the basic information of each object 2, and can determine whether the basic information of each object 2 contains the application form. When the basic information of one object 2 contains the application form, the determining module 14 can further determine whether the application form has been approved. When the application form has been approved, the updating module 12 can update the status information of the one object 2 to be in the approved state.

At block S503, the obtaining module 13 can obtain position information from each positioning tag 200 at every predetermined time and can obtain the status information of the object 2 that corresponds to the each positioning tag 200 at the every predetermined time.

At block S504, the determining module 14 can determine whether each object 2 is located in the area of the warehouse 1 according to the obtained position information. When each object 2 is located in the area of the warehouse 1, the process goes to block S503. When at least one object 2 is not located in the area of the warehouse 1, the process goes to block S505.

At block S505, the determining module 14 can further determine whether the at least one object 2 is in the approved state according to the status information of the at least one object 2. When the at least one object 2 is in the approved state, the process goes to block S503. When the at least one object 2 is not in the approved state, the process goes to block S506.

At block S506, the controlling module 15 can control the positioning tag 200 corresponding to the at least one object 2 to transmit the alarm, so as to prompt the manager of the warehouse 1 that the at least one object is in an abnormal state, thus preventing theft or improper placement of the at least one object 2.

At block S507, the controlling module 15 can generate the movement path of each object 2 according to the positioning information obtained from the positioning tag 200 corresponding to the each object 2. The controlling module 15 further can control the display device 50 to display the movement path in response to user input.

At block S508, the controlling module 15 can control one or more positioning tags 200 to light the lighting devices 202 of the one or more positioning tags 200 in response to user input. In at least one exemplary embodiment, the user input can be input of the server. In other exemplary embodiments, the user input can be input of the mobile terminal 400.

At block S509, the controlling module 15 further can control one or more camera devices 300 corresponding to the one or more positioning tags 200 to capture images. The controlling module 15 further can control the one or more camera devices 300 to send the captured images to the mobile terminal 400, to enable the manager to use the mobile terminal 400 and remotely view the objects 2 stored in the warehouse 1.

It should be emphasized that the above-described exemplary embodiments of the present disclosure, including any particular exemplary embodiments, are merely possible examples of implementations, set forth for a clear understanding of the principles of the disclosure. Many variations and modifications can be made to the above-described exemplary embodiment(s) of the disclosure without departing substantially from the spirit and principles of the disclosure. All such modifications and variations are intended to be included herein within the scope of this disclosure and protected by the following claims.

What is claimed is:

1. A server comprising:

a storage device; and at least one processor, wherein the storage device stores one or more programs, wherein when executed by the at least one processor, cause the at least one processor to:

establish a relationship between basic information of each object of a plurality of objects and each positioning tag of a plurality of positioning tags, wherein the basic information of each object comprises status information of each object of the plurality of objects;

obtain position information from each positioning tag at every predetermined time;

obtain the status information of each object of the plurality of objects at every predetermined time;

determine whether each object of the plurality of objects is in an predetermined area according to the obtained position information;

determine whether the at least one object of the plurality of objects is in an approved or not approved state according to the status information of the at least one object of the plurality of objects; and control the positioning tag corresponding to the at least one object of the plurality of objects to transmit an alarm when the at least one object of the plurality of objects is not in the approved state and the at least one object of the plurality of objects is not located in the predetermined area.

2. The server according to claim 1, wherein the at least one processor is further caused to:

obtain the basic information of each object of the plurality of objects;

determine whether the basic information of each object of the plurality of objects further containing an application form;

determine whether the application form in each object of the plurality of objects having the application form being in an approved state in response to the basic information of the object containing the application form;

update the status information of each object of the plurality of objects to be in the approved state in response to the approved application form.

3. The server according to claim 1, wherein the at least one processor is further caused to:

generate a movement path of each object of the plurality of objects according to the positioning information obtained from the positioning tag corresponding to each object of the plurality of objects; and control a display device of the server to display the movement path in response to user input.

4. The server according to claim 1, wherein the at least one processor is further caused to:

control one or more positioning tags to turn on lighting devices of the one or more positioning tags in response to user input.

5. The server according to claim 1, wherein the at least one processor is further caused to:

control one or more positioning tags to light lighting devices of the one or more positioning tags in response to user input of a mobile terminal; and control one or more camera devices corresponding to the one or more positioning tags to capture images and send the captured images to the mobile terminal.

6. A managing method that is applied to a server, comprising:

establishing a relationship between basic information of each object of a plurality of objects and each positioning tag of a plurality of positioning tags, wherein the basic information of each object comprises status information of each object of the plurality of objects;

obtaining position information from each positioning tag at every predetermined time;

obtaining the status information of each object of the plurality of objects at every predetermined time;

determining whether each object of the plurality of objects is in an predetermined area according to the obtained position information;

determining whether the at least one object of the plurality of objects is in an approved or not approved state according to the status information of the at least one object of the plurality of objects; and controlling the positioning tag corresponding to the at least one object of the plurality of objects to transmit an alarm when the at least one object of the plurality of objects is not in the approved state and the at least one object of the plurality of objects is not located in the predetermined area.

7. The managing method according to claim 6, further comprising:

obtaining the basic information of each object of the plurality of objects;

determining whether the basic information of each object of the plurality of objects further containing an application form;

determining whether the application form in each object of the plurality of objects having the application form being in an approved state in response to the basic information of the object containing the application form;

updating the status information of each object of the plurality of objects to be in the approved state in response to the approved application form.

8. The managing method according to claim 6, further comprising:

generating a movement path of each object of the plurality of objects according to the positioning information obtained from the positioning tag corresponding to each object of the plurality of objects; and controlling a display device of the server to display the movement path in response to user input.

9. The managing method according to claim 6, further comprising:

controlling one or more positioning tags to turn on lighting devices of the one or more positioning tags in response to user input.

10. The managing method according to claim 6, further comprising:

controlling one or more positioning tags to light lighting devices of the one or more positioning tags in response to user input of a mobile terminal; and controlling one or more camera devices corresponding to the one or more positioning tags to capture images and send the captured images to the mobile terminal.

11. A non-transitory storage medium having stored thereon instructions that, when executed by a processor of a server, causes the processor to perform a managing method, wherein the method comprises:

establishing a relationship between basic information of each object of a plurality of objects and each positioning tag of a plurality of positioning tags, wherein the basic information of each object comprises status information of each object of the plurality of objects;

obtaining position information from each positioning tag at every predetermined time;

obtaining the status information of each object of the plurality of objects at every predetermined time;

determining whether each object of the plurality of objects is in an predetermined area according to the obtained position information;

determining whether the at least one object of the plurality of objects is in an approved or not approved state according to the status information of the at least one object of the plurality of objects; and controlling the positioning tag corresponding to the at least one object of the plurality of objects to transmit an alarm when the at least one object of the plurality of objects is not in the approved state and the at least one object of the plurality of objects is not located in the predetermined area.

12. The non-transitory storage medium according to claim 11, wherein the method further comprises:

obtaining the basic information of each object of the plurality of objects;

determining whether the basic information of each object of the plurality of objects further containing an application form;

determining whether the application form in each object of the plurality of objects having the application form being in an approved state in response to the basic information of the object containing the application form;

updating the status information of each object of the plurality of objects to be in the approved state in response to the approved application form.

13. The non-transitory storage medium according to claim 11, wherein the method further comprises:

generating a movement path of each object of the plurality of objects according to the positioning information obtained from the positioning tag corresponding to each object of the plurality of objects; and controlling a display device of the server to display the movement path in response to user input.

14. The non-transitory storage medium according to claim 11, wherein the method further comprises:

controlling one or more positioning tags to turn on lighting devices of the one or more positioning tags in response to user input.

15. The non-transitory storage medium according to claim 11, wherein the method further comprises:

controlling one or more positioning tags to light lighting devices of the one or more positioning tags in response to user input of a mobile terminal; and controlling one or more camera devices corresponding to the one or more positioning tags to capture images and send the captured images to the mobile terminal.

* * * * *